US007400556B2

(12) United States Patent
Osa et al.

(10) Patent No.: US 7,400,556 B2
(45) Date of Patent: Jul. 15, 2008

(54) ELECTRONIC TIMEPIECE WITH SOLAR CELL

(75) Inventors: Takashi Osa, Tokyo (JP); Tomomi Murakami, Tokyo (JP); Hitoshi Fujita, Tokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 102 days.

(21) Appl. No.: 10/541,725

(22) PCT Filed: Dec. 12, 2003

(86) PCT No.: PCT/JP03/15919

§ 371 (c)(1),
(2), (4) Date: Jul. 11, 2005

(87) PCT Pub. No.: WO2004/066042

PCT Pub. Date: Aug. 5, 2004

(65) Prior Publication Data

US 2006/0153011 A1 Jul. 13, 2006

(30) Foreign Application Priority Data

Jan. 23, 2003 (JP) ..... 2003-014406

(51) Int. Cl.
*G04C 10/00* (2006.01)

(52) U.S. Cl. ..... 368/205; 368/204

(58) Field of Classification Search ..... 368/203, 368/205, 297, 299
See application file for complete search history.

(56) References Cited

U.S. PATENT DOCUMENTS 4,553,851 A * 11/1985 Matsumoto et al. ..... 368/205
6,521,822 B2 * 2/2003 Ito et al. ..... 136/244

FOREIGN PATENT DOCUMENTS

| | | | |
|---|---|---|---|
| JP | 58-26696 | | 8/1956 |
| JP | 52-109378 | | 9/1977 |
| JP | 58-86592 | | 6/1983 |
| JP | 52-120983 | | 7/1984 |
| JP | 59-152480 | | 10/1984 |
| JP | 59176690 | A * | 10/1984 |
| JP | 59176691 | A * | 10/1984 |
| JP | 60-146887 | | 9/1985 |
| JP | 62-16491 | | 1/1987 |
| JP | 62-42390 | | 10/1987 |
| JP | 10-177077 | | 6/1998 |
| JP | 2001298203 | A * | 10/2001 |
| JP | 2003-121567 | | 4/2003 |

* cited by examiner

*Primary Examiner*—Renee Luebke
*Assistant Examiner*—Jeanne-Marguerite Goodwin
(74) *Attorney, Agent, or Firm*—Manabu Kanesaka

(57) ABSTRACT

An electronic timepiece with a solar cell includes a timepiece movement, a timepiece case for housing the timepiece movement, a casing ring for housing and holding the timepiece movement in the timepiece case, a solar cell and a dial. The solar cell is disposed almost vertically to a solar cell positioning portion provided in the casing ring, and the solar cell has a slender strip shape formed on a flexible substrate. Consequently, the solar cell is not disposed in the timepiece movement, and it is only necessary to change the casing ring as an external component even when a panel cover diameter is changed. Further, a solar cell can be coiled to match the size of the casing ring when it is incorporated in the casing ring, so that a common solar cell can be used despite a change in the panel cover diameter of the timepiece.

17 Claims, 17 Drawing Sheets

Conditions :

Illuminance : 500 lux

Operating voltage : 0.45V

Completed timepiece (Dial color : Black)

ELECTRONIC TIMEPIECE WITH SOLAR CELL

The present application is based on International Application No. PCT/JP2003/015919 filed Dec. 12, 2003, and claims priority from, Japanese Application Number 2003-14406. filed Jan. 23, 2003, the disclosure of which is hereby incorporated by reference herein in its entirety.

TECHNICAL FIELD

The present invention relates to an electronic timepiece with a solar cell in which a solar cell is arranged on a facing ring in a timepiece having a solar power generation system which generates a power by utilizing a light and a charging system which charges the power generated by this solar power generation system.

BACKGROUND ART

Many electronic timepieces each of which has a solar cell and utilizes a light such as a sunlight as a power generation source have been conventionally commercialized. In these electronic timepieces, when a solar cell is arranged under a light semi-permeable dial, a design of the dial is restricted, and commodities with various designs cannot be proposed.

That is, since the surface of the solar cell has a dark brown color, the dial must be arranged on the solar cell in order to hide this color of the surface. On the other hand, in order to generate the power upon receiving a light at the solar cell, properties which transmit a light to some extent, i.e., the light permeability is required. Therefore, using a white color to the dial results in the dial having an off-white color tone like frosted glass, and a beautiful white color cannot be obtained, thereby restricting the design.

Meanwhile, a reduction in power consumption of timepieces has advanced in recent years, and each timepiece can be driven even if an area of a solar cell is decreased to some extent. Thus, an electronic timepiece with a solar cell in which a solar cell is arranged on an outer periphery substantially vertically with respect to the dial has been proposed. Such a prior art is disclosed in Japanese Utility Model Application Laid-open No. 42390-1987 (Patent Reference 1) or Japanese Patent Application Laid-open No. 2002-148366 (Patent Reference 2). There is a timepiece in which a solar cell formed on a strip-like printed board having the flexibility is wound on a wall surface of a gap portion between a windshield and a dial.

FIGS. 17 to 20 show an embodiment described in Patent Reference 1, in which FIGS. 17 and 18 show a first embodiment and FIGS. 19 and 20 show a second embodiment.

A solar cell block 121 shown in FIG. 18 has a configuration in which a plurality of solar cells 123 are mounted on a flexible printed board 122, these solar cells 123 are connected with each other through an electrode pattern and spacers 124 are arrange to fill gaps between the solar cells 123. A solar cell block 121 is bonded to a support ring 125 through the flexible printed board.

FIG. 18 is a cross-sectional view of a wrist watch showing a state in which the solar cell block 121 depicted in FIG. 19 is assembled in a watch case 127. In the solar cell block 121, the surface of each solar cell 123 is erected with respect to a dial 126 and faces the center of the watch. This solar cell block 121 is configured to be attached to the support ring 125.

A solar cell block 131 shown in FIG. 21 is obtained by forming solar cells 133 each consisting of amorphous silicon on a stainless sheet 132 on which an insulating film is applied.

The plurality of solar cells 133 are connected with each other through positive and negative electrodes 134*a* and 134*b* arranged at both ends of the stainless sheet 132 and a wiring pattern 135.

FIG. 20 is a cross-sectional view of a wrist watch showing a state in which the solar cell block 131 depicted in FIG. 21 is assembled in a watch case 136. The solar cell block 131 formed of a flexible stainless sheet is wound on the inner side of a facing inner wall surface 137 of the watch case 136, and the solar cell block 131 is arranged in such a manner that the solar cells 133 are erected with respect to the dial 138 and face the center of the watch.

FIGS. 22 and 23 show the first embodiment described in Patent Reference 2.

FIG. 22 is a plan view of an elongated strip-like solar cell 141 formed on a substrate 140 having the flexibility, and positive and negative electrodes 147*a* and 147*b* are arranged at both ends of the solar cell 141.

FIG. 23 is a cross-sectional view showing a state in which a solar cell 141 is assembled in a watch case 146. As to the solar cell 141-in FIG. 23, there is shown a cross-sectional view taken along a D-D line in FIG. 22 and a part where the positive/negative electrode 147*a* (147*b*) of the solar cell 141 is in contact with a connection spring 148. The solar cell 141 is arranged on an inner peripheral surface 144*a* of an annular banking portion 144 along an outer peripheral portion of a timepiece movement 142 above an arrangement surface 142*a* of a dial 143 of the timepiece movement 142. This solar cell 141 is assembled in a watch case 146 with a facing ring 145 having the light permeability being arranged on the inner side.

However, in the configuration according to the first embodiment of Parent Reference 1 shown in FIG. 18, the plurality of solar cells 123 are circularly arranged, electrically connected in series and have a fixed length. Therefore, when the same solar cell block 121 as this embodiment is assembled in a timepiece having a small panel cover diameter, a light is not applied to some solar cells 123 because the solar cells 123 overlap each other. However, the solar cell block 121 has a problem that the necessary power cannot be obtained since the output power from the solar cells 123 on which a light is not applied restricts the entire output power.

Likewise, since the solar cells 133 are electrically connected in series, the second embodiment of Patent Reference 1 shown in FIG. 20 has the same problem as the first embodiment of Patent Reference 1 shown in FIG. 18.

Further, in case of the solar cell block 131 of the second embodiment of Patent Reference 1, since the positive and negative electrodes 134*a* and 134*b* for fetching the generated power are provided at both ends of the solar cell block 131, there is a problem that the positive and negative electrodes 134*a* and 134*b* overlap each other and hence the power cannot be fetched when this solar cell block 131 is used in a timepiece having a small panel cover diameter.

Likewise, the first embodiment of Patent Reference 2 shown in FIGS. 22 and 23 has the same problem as the second embodiment of Patent Reference 1 since the positive and negative electrodes 147*a* and 147*b* for fetching the generated power are provided at both ends.

It is to be noted that the panel cover diameter means a diameter of a shape in a plane direction in a space in which hour/minute/second hands are arranged between a dial and a windshield, and it means an internal diameter of a facing ring in case of a timepiece having the facing ring formed therein.

Furthermore, in the configuration of the first embodiment of Patent Reference 2, since the annular banking portion 144 on which the solar cell 141 is arranged is formed on a timepiece movement component, there is a problem that the timepiece movement component on which the solar cell is arranged must be changed in case of varying a panel cover diameter.

It is to be noted that reducing the internal diameter of the facing ring 145 alone to increase a width W of the facing ring 145 can be considered in case of a timepiece having a small panel cover diameter, but a timepiece having a large external diameter of the timepiece case 146 with respect to the panel cover diameter is obtained, resulting in a design problem.

As described above, the prior art has a problem that the solar cell or the timepiece movement component on which the solar cell is arranged cannot be used in common in a timepiece having a different panel cover diameter, and that the solar cell, the solar cell block and the watch movement component on which such members are arranged must be newly recreated in accordance with a panel cover diameter.

It is, therefore, an object of the present invention to provide, in an electronic timepiece with a solar cell in which the solar cell is arranged substantially vertically to a dial, an electronic timepiece with a solar cell having a configuration in which a common solar cell and a common timepiece movement can be used irrespective of a panel cover diameter size.

DISCLOSURE OF THE INVENTION

According to the present invention, there is provided an electronic timepiece with a solar cell in which the solar cell is arranged substantially vertically to dial, the electronic timepiece with the solar cell comprising: a timepiece movement; a timepiece case which accommodates the timepiece movement therein; a casing ring which accommodates and holds the timepiece movement in the timepiece case; a solar cell; and a dial, wherein the solar cell is arranged at a solar cell positioning portion provided in the casing ring. As a result, the solar cell does not have to be arranged in the timepiece movement, it is only necessary to change a casing ring as an external component even when a panel cover diameter is changed, allowing a common use of the timepiece movement.

Moreover, according to the present invention, the solar cell is a slender strip-shaped solar cell formed on a flexible substrate.

When the solar cell has a slender strip shape in this manner, the solar cell can be coiled to match the size of the casing ring when it is incorporated in the casing ring, therefore a common solar cell can be used despite a change in the panel cover diameter of the timepiece.

Additionally, according to the present invention, positive and negative electrodes of the solar cell are arranged on an end portion on the same side of the solar cell.

In cases where the positive and negative electrodes are arranged on both ends of the solar cell like the prior art, a relative position of the positive and negative electrodes varies when a panel cover diameter of the timepiece is changed. However, when the positive and negative electrodes are arranged at an end portion on the same side of the solar cell like the present invention, a relative position of the positive and negative electrodes does not vary even if a panel cover diameter is changed. Therefore, a connection configuration of the solar cell with respect to the positive and negative electrodes and the timepiece movement does not have to be changed, and a common timepiece movement can be used irrespective of a women's timepiece and a men's timepiece.

The present invention has a configuration in which an extraction electrode which fetches the generated power of the solar cell and the solar cell are separately manufactured and bonded to each other.

As a result, shapes of the extraction electrode and the solar cell can be simplified to facilitate production, thereby reducing a processing cost. Further, when a panel cover shape of the timepiece is greatly changed, just varying a length (or a shape) of the extraction electrode enables a common use of the solar cell.

Furthermore, the present invention has a configuration in which the dial is a dial having a plurality of sides forming a main outer peripheral shape and corner portions which connect intersections of the plurality of sides, the solar cell has a plurality of photovoltaic portions arranged substantially vertically to the dial along the plurality of sides of the dial and the plurality of photovoltaic portions are electrically connected with each other in parallel.

With such an arrangement, a solar cell comprising a photovoltaic portion (a photovoltaic area) formed of a very fragile material does not have to be arranged at each corner portion of the dial, and hence each photovoltaic portion does not have to be bent with a very small radius and used in this state, thereby forming a free dial shape. Moreover, just preparing one strip-like solar cell comprising a plurality of photovoltaic portions can constitute an electronic timepiece with a solar cell, and a simple configuration can be obtained and a cost can be reduced as compared with a case in which a plurality of strip-like solar cells are independently arranged.

It is to be noted that the photovoltaic portions can be configured by arranging a plurality of amorphous silicon layers in a widthwise direction of a substrate and electrically connecting these layers in series.

Additionally, according the present invention, an outer peripheral shape of the dial formed of the plurality of sides and the corner portions is a rectangular shape or a barrel shape.

As a result, the present invention can be adopted to a dial having a rectangular or barrel outer peripheral shape, and the electronic timepiece with a solar cell can have many design variations.

BEST MODE FOR CARRYING OUT THE INVENTION

An embodiment according to the present invention will now be described hereinafter with reference to the accompanying drawings.

It is to be noted that the present invention is not restricted to this embodiment.

A configuration of a solar cell according to the embodiment will be first described.

Figure 1:
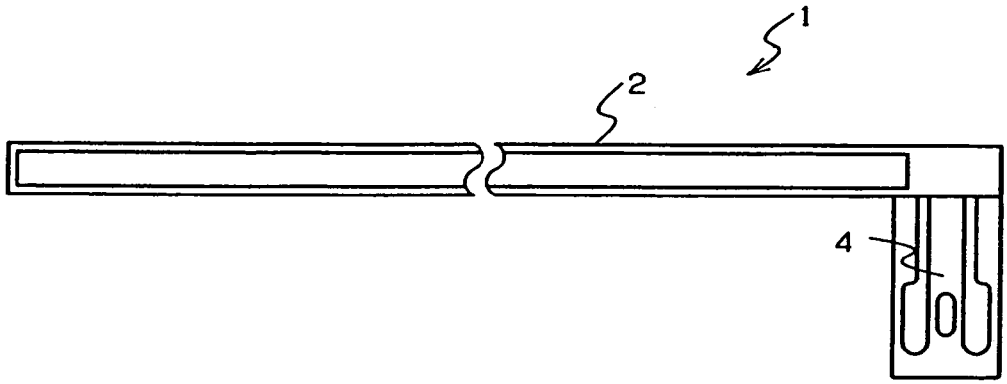
FIG. 1 is a plan view of a completed solar cell according to an embodiment of the present invention.

FIG. 1 is a plan view of a completed solar cell 1, and shows a state in which a solar cell 2 and an extraction electrode 4 are integrated by thermo compression bonding.

Figure 2:
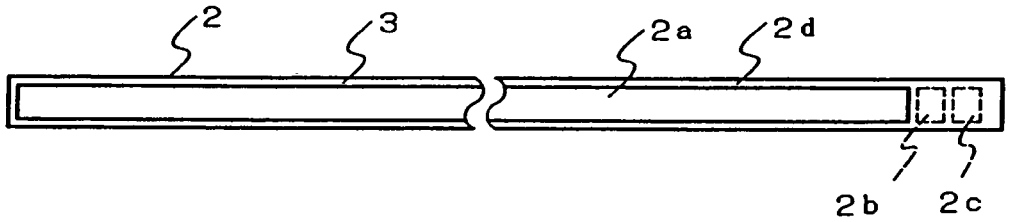
FIG. 2 is a plan view of a solar cell according to the embodiment of the present invention.

FIG. 2 is a plan view of the solar cell. The solar cell 2 is a slender strip-like flexible solar cell which is a single cell obtained by forming an amorphous silicon layer or the like on a base substrate 3 formed of a PET film, and has a photovoltaic area 2*a* which receives a light to generate the power and positive and negative electrodes 2*b* and 2*b* aligned and arranged at an end portion on the same side on the rear surface side of the photovoltaic area 2*a*.

An outer shape of the solar cell 2 is a slender strip shape having a length of approximately 96.8 mm, a width of 2.4 mm and a thickness of approximately 0.15 mm, and the photovoltaic area 2*a* has a size of approximately 92.1 mm and a width of 1.6 mm. Although an edge portion 2*d* which has a width of approximately 0.4 mm and does not generate the power even when a light is applied thereto is provided on the entire outer periphery of the photovoltaic area 2*a*, this is a cut width when cutting and separating individual solar cells from a sheet having many solar cells formed on a large PET film.

Figure 3:
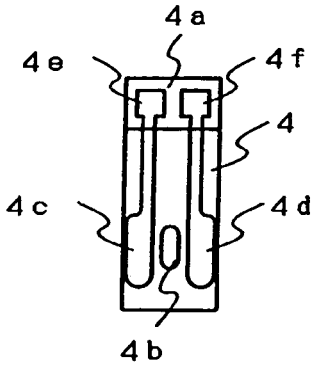
FIG. 3 is a plan view of an extraction electrode according to the embodiment of the present invention.

FIG. 3 is a plan view of an extraction electrode 4. The extraction electrode 4 has positive and negative electrodes 4*c* and 4*d* formed on a flexible printed board having a total thickness of approximately 0.1 mm. An anisotropic conductive adhesive is applied on a bonding surface 4*a* of the extraction electrode 4 with respect to the solar cell 2, and positions of the positive and negative electrodes 4*c* and 4*d* of the solar cell 2 and bonding electrodes 4*e* and 4*f* of the extraction electrode 4 are positioned and then bonded to each other by thermo compression bonding, thereby forming the completed solar cell 1.

A slot 4*b* which is used to adjust an attachment position is provided to the extraction electrode 4. Elongated positive and negative output electrode patterns 4*c* and 4*d* are provided on both sides of this slot 4*b*, and the generated power from the completed solar cell 1 is supplied to a non-illustrated timepiece circuit board by connecting the extraction electrode 4 with the timepiece circuit board.

Figure 4:
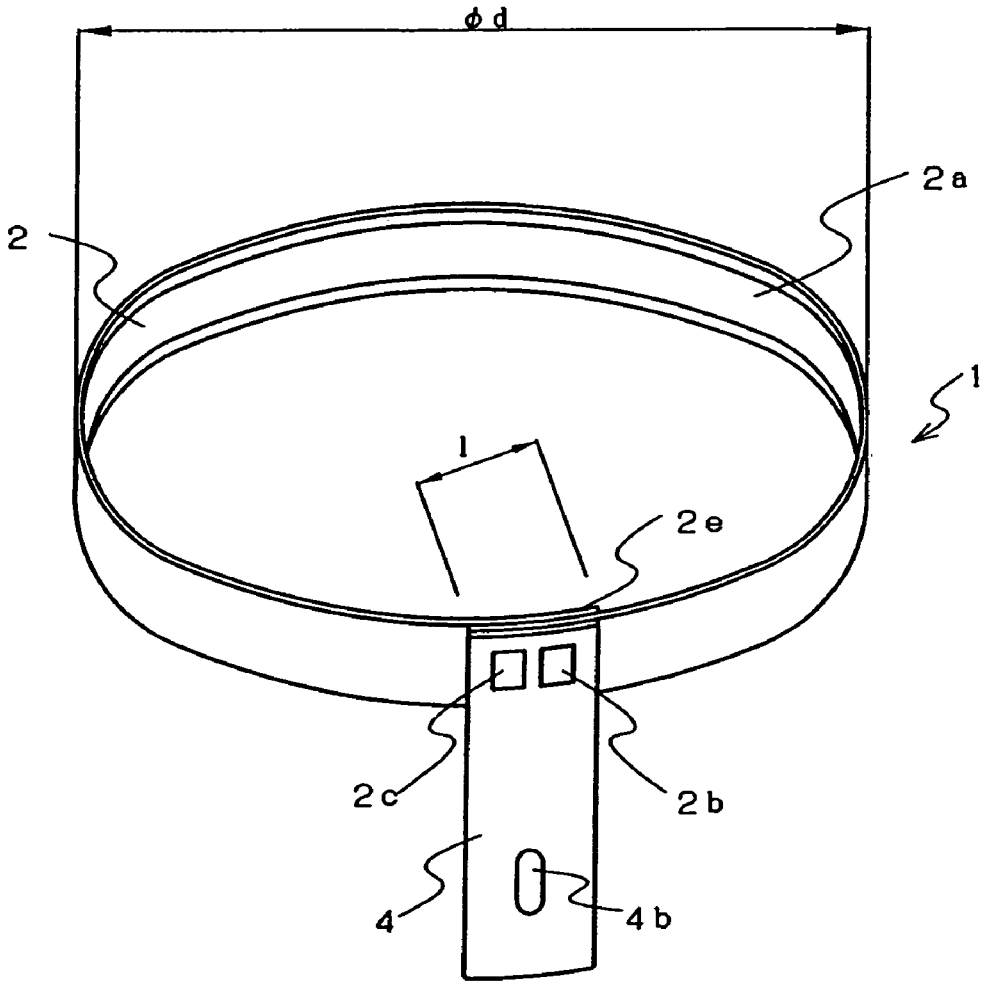
FIG. 4 is a perspective view showing a state in which the completed solar cell according to the embodiment of the present invention is incorporated in a casing ring for a men's timepiece having a large panel cover diameter.

FIG. 4 is a perspective view of the completed solar cell 1 when incorporated in a timepiece case. The completed solar cell 1 is wound in such a manner the photovoltaic area 2*a* faces the center of the timepiece as shown in FIG. 4, and then incorporated in the timepiece.

The photovoltaic area 2*a* cannot be arranged at the part of the positive and negative electrodes 2*b* and 2*c* of the solar cell 2. Therefore, it is good enough to wind the completed solar cell 1 in such a manner that the part on which the extraction electrode 4 is attached is set to the outer side and the other end portion 2*e* on which the positive and negative electrodes 2*b* and 2*c* of the solar cell 2 are not arranged is set to the inner side in order to assure a large power generation area. It is to be noted that reference character 1 denotes an overlapping portion of the solar cell 2.

Figure 5:
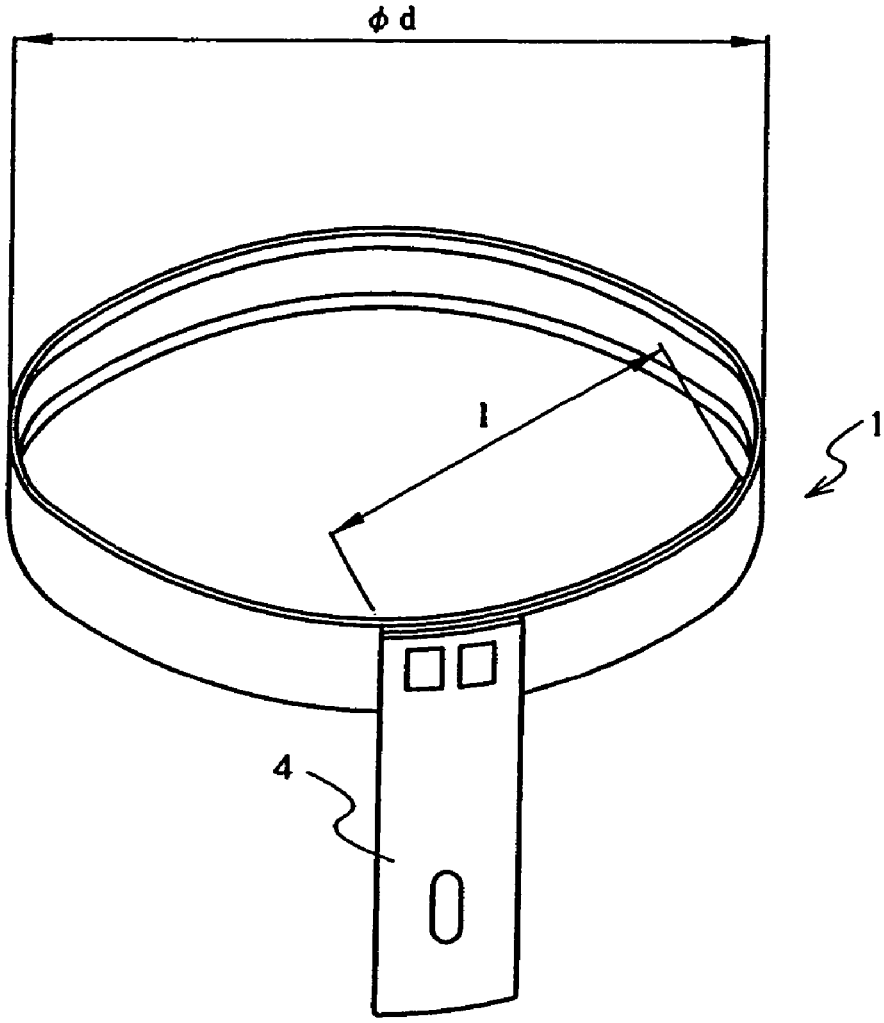
FIG. 5 is a perspective view showing a state in which the completed solar cell according to the embodiment of the present invention is incorporated in a casing ring for a women's timepiece having a small panel cover diameter.

FIG. 5 is a perspective view of the completed solar cell showing a state in which the completed solar cell 1 having the same length as that shown in FIG. 4 is wound when incorporated in a timepiece case having a small panel cover diameter, and an overlapping portion 1 of the solar cell is wide since a winding diameter (ϕd) is smaller than that shown in FIG. 4.

An embodiment of the electronic timepiece with a solar cell according to the present invention will now be described.

Figure 6:
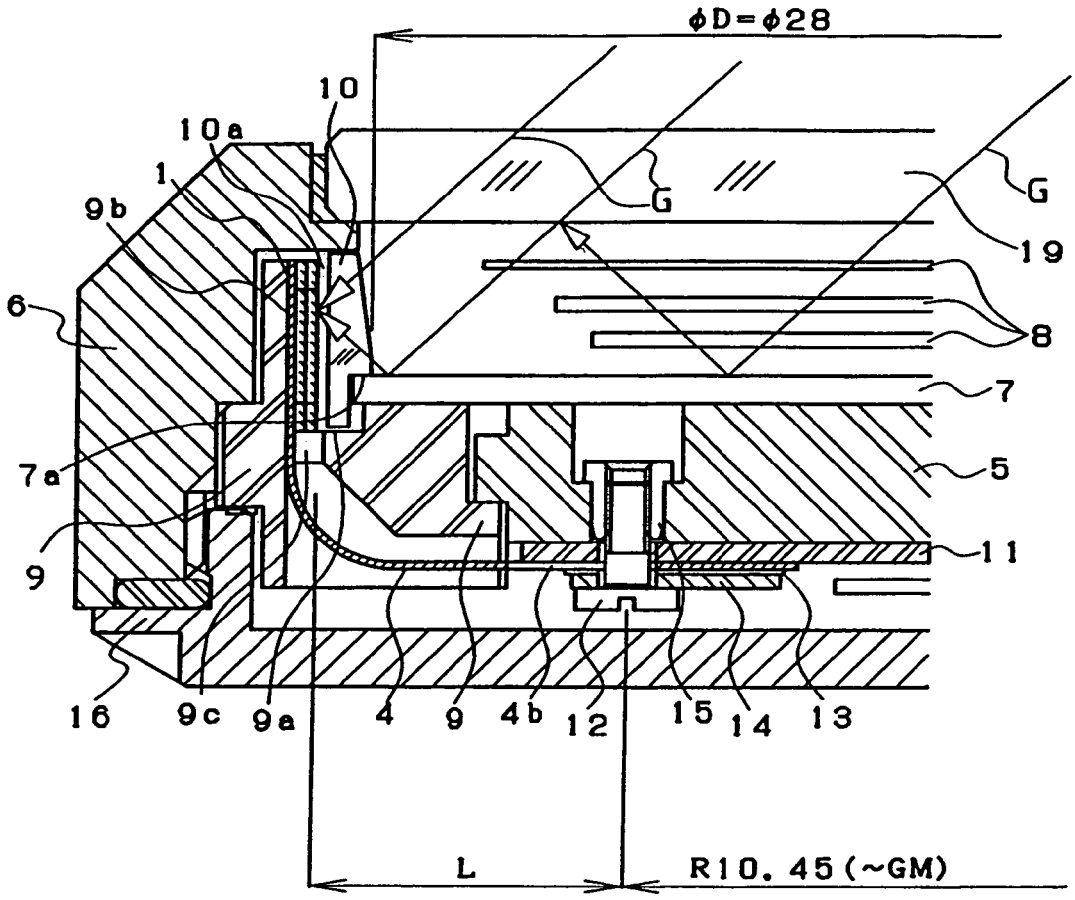
FIG. 6 is a cross-sectional view of a primary part of a men's electronic timepiece with a solar cell showing the embodiment of the present invention.

FIG. 6 is a cross-sectional view of an electronic timepiece with a solar cell according to an embodiment of the present invention, showing a cross-sectional view of a primary part in case of a men's timepiece having a panel cover diameter of ϕ28 mm.

A timepiece movement 5 is fitted in a donut-shaped casing ring 9, a light-permeable facing ring 10 is mounted on a dial outer rim 7*a* after attaching a dial 7 and hour/minute/second hands 8, and the timepiece movement 5 is incorporated in a timepiece case 6. A completed solar cell 1 is incorporated in the casing ring 9 in advance.

It is to be noted that the casing ring 9 is an external component which accommodates and holds the timepiece movement 5 in the timepiece case 6 when incorporating the timepiece movement 5 in the timepiece case 6 and absorbs an impact shock from the outside of the timepiece, and many types of the casing rings 9 are manufactured in accordance with individual timepiece cases 6.

An annular step portion 9*a* which is a positioning portion of the solar cell 1 is formed to the casing ring 9. The completed solar cell 1 is coiled to be accommodated in this annular step portion 9*a*, and the completed solar cell 1 is attached and arranged on an inner peripheral surface 9*b* of the step portion 9*a* by a tensile force provided when the coiled completed solar cell 1 tries to expand, an adhesive or the like.

Further, the extraction electrode 4 of the completed solar cell 1 is drawn toward a back 16 side through a hole portion 9*c* provided to the casing ring 9, and a screw 12 is inserted into a slot 4*b* of the extraction electrode 4 through an insulating sheet 13 and a presser plate 14 and fixed to a positioning tube 15. Incidentally, in this embodiment, as a position of the positioning tube 15 arranged to the casing ring 9, an example where this position is set at a place which is 10.4 mm from the center of the timepiece is shown. As a result, the completed solar cell 1 can be electrically connected with the circuit board 11.

Figure 7:
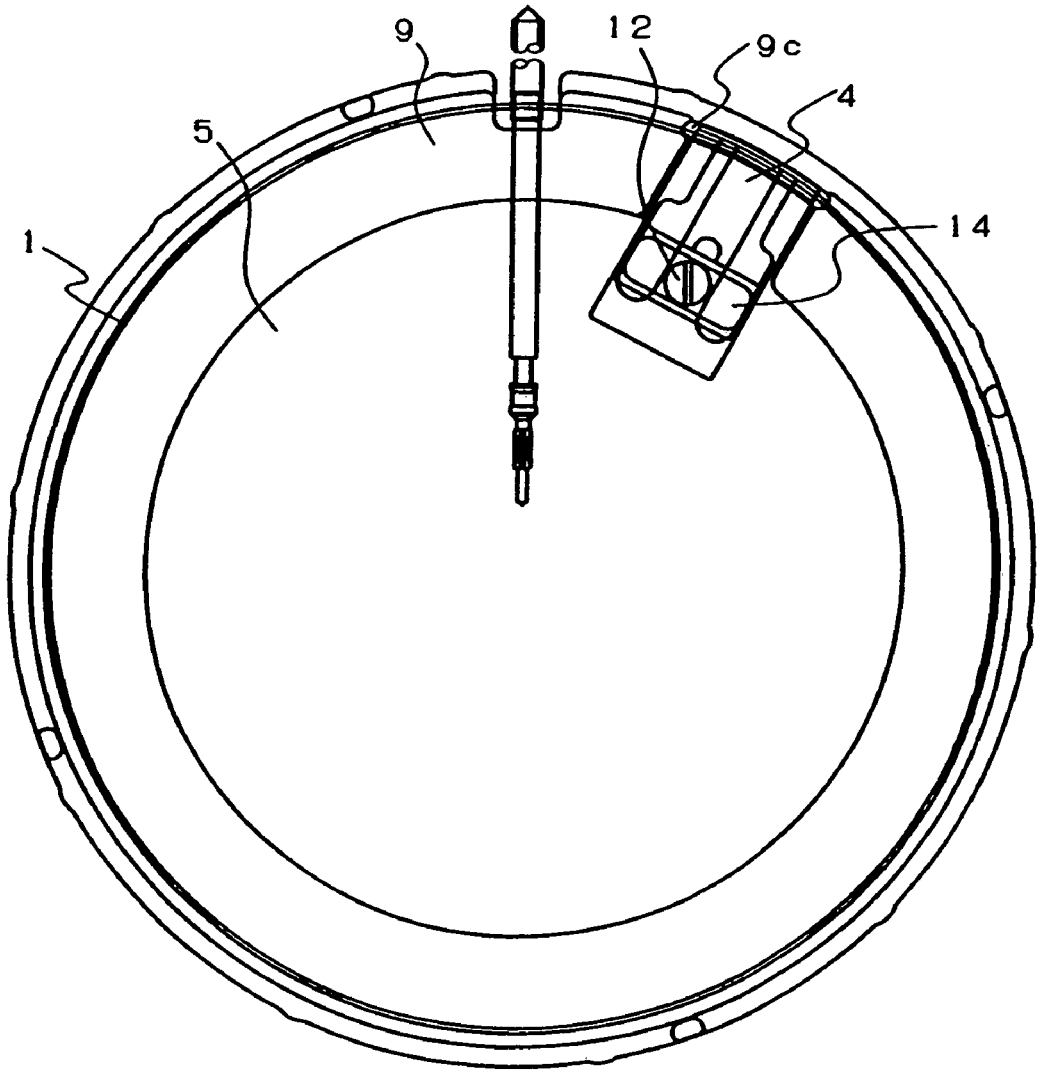
FIG. 7 is a plan view showing a state in which a timepiece movement of the electronic timepiece with a solar cell depicted in FIG. 6 is fitted in a casing ring.

FIG. 7 is a plan view of the electronic timepiece with a solar cell, showing a state in which the timepiece movement 5 is accommodated in the donut-shaped casing ring 9 having the completed solar cell 1 incorporated therein. Further, FIG. 7 shows a state in which the extraction electrode 4 drawn from the hole portion 9*c* of the casing ring 9 is fixed to a non-illustrated circuit board by using the screw 12 through the presser plate 14 or the like.

Figure 8:
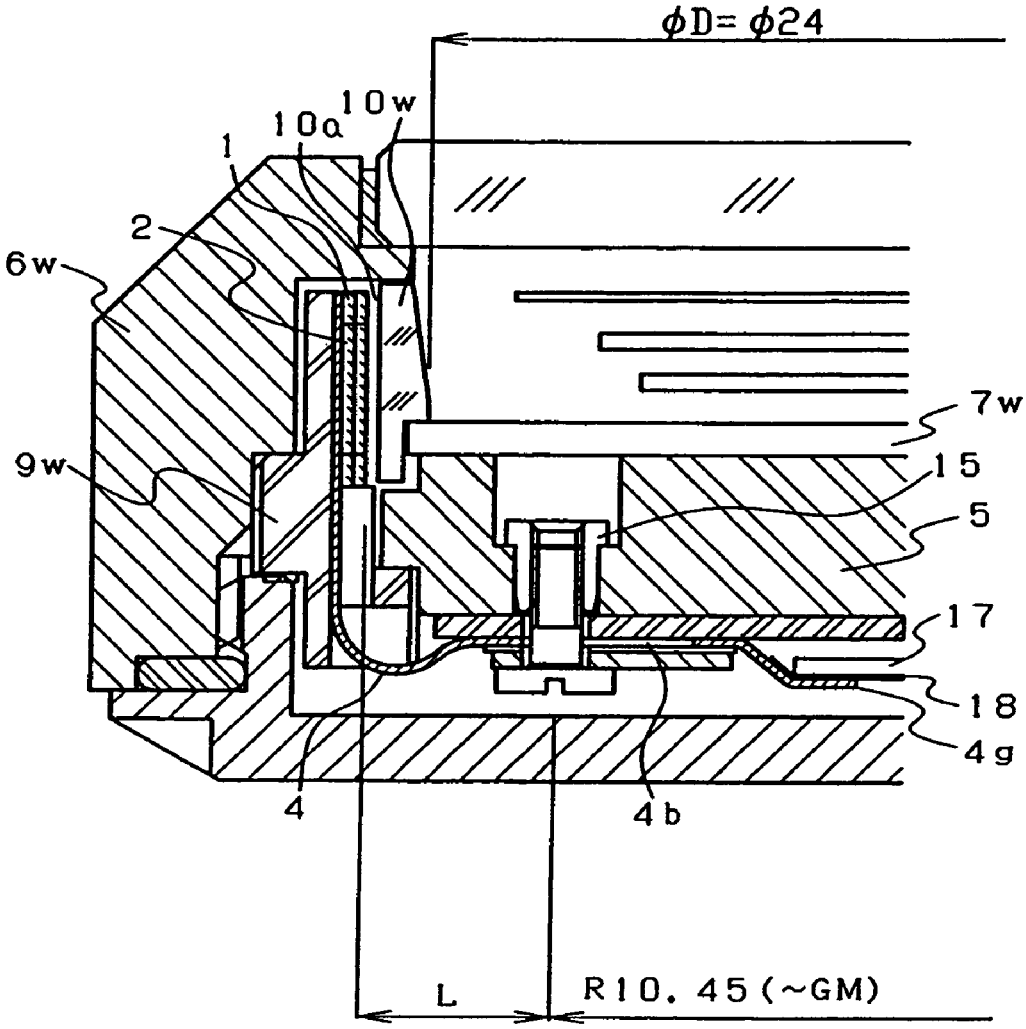
FIG. 8 is a cross-sectional view of a primary part of a women's electronic timepiece with a solar cell showing the embodiment according to the present invention.

FIG. 8 is a cross-sectional view of the electronic timepiece with a solar cell, showing a cross-sectional view of a primary part in case of a women's timepiece having a panel cover diameter of ϕ24 mm. Although the panel cover diameter is small as compared with the example shown in FIG. 6, the same completed solar cell 1 and timepiece movement 5 as those depicted in FIG. 6 are used. In this embodiment, the positioning tube 15 which fixes the extraction electrode 4 of the completed solar cell 1 arranged in the casing ring 9*w* is placed at a position which is 10.45 mm from the center of the timepiece, which is the same as the men's timepiece having the panel cover diameter of ϕ28 mm shown in FIG. 6.

It is to be noted that radial dimensions of the timepiece case 6*w*, the dial 7*w* and the facing ring 10*w* as external components as well as the casing ring 9*w* which holds the timepiece movement 5 in the timepiece case 6w are smaller than those of the components depicted in FIG. 6.

Although the completed solar cell 1 used in the women's timepiece is the same as that in the men's timepiece, increasing a length of the overlapping portion 1 of the completed solar cell 1 to compensate a reduction in the panel cover diameter as shown in FIG. 5 enables a common use of the same completed solar cell 1.

Furthermore, although the women's timepiece has a smaller distance L between the completed solar cell 1 and the positioning tube 15 than the men's timepiece, the hole 4*b* for fixing the extraction electrode 4 has a slot-like shape and the elongated positive and negative output electrode patterns 4*c* and 4*d* connected with the positive and negative output electrodes of the solar cell 2 are formed on the both sides of the slot 4*b*, and hence the same extraction electrode 4 can be used in common within a fixed range even if the distance L between the completed solar cell 1 and the positioning tube 15 is changed.

With the configuration mentioned above, the solar cell 2 and the extraction electrode 4 can be used in common irrespective of the men's timepiece and the women's timepiece, thereby enabling a common use of the completed solar cell 1.

As described above, in order to obtain design variations of a wrist watch, preparing a plurality of exterior designs with respect to one timepiece movement is generally performed. That is, a timepiece case, a dial, hands, a casing ring and others as external components are designed and manufactured by using the same timepiece movement in accordance with timepieces having different designs and different sizes. Therefore, there is no problem in preparing some casing rings of respective sizes which are an external component used to arranged a solar cell in accordance with designs with different panel cover diameters like the present invention.

It is to be noted that since the distance L between the completed solar cell 1 and the positioning tube 15 in FIG. 8 is smaller than that in FIG. 6, an extraction electrode end portion 4*g* is close to the center of the timepiece movement 5. Therefore, there is the possibility of the short circuit due to contact between a non-illustrated connection pattern of the extraction electrode and a metallic circuit support plate 17. Thus, as a countermeasure, an insulating sheet 18 is arranged between the extraction electrode 4 and the circuit support substrate 17.

Further, there is an air layer 10*a* between the facing ring 10 and the completed solar cell 1, a light transmitted through the facing ring 10 is reflected on an interface to cause refraction or scattering, and hence there is the effect that a dark brown color of the solar cell 2 is hard to see from the outside.

It is to be noted that the facing ring 10 is formed by injection molding using a clear and colorless polycarbonate resin having the light permeability, and the facing ring 10 has a glossy surface.

A power generating operation of the electronic timepiece with a solar cell in this embodiment will now be described with reference to FIG. 6.

As to incidence of a light on the completed solar cell 1, there are a case where a light 20 transmitted through the windshield 19 is directly transmitted through the light permeable facing ring 10 and a case where the light 20 transmitted through the windshield 19 is reflected by the dial 7 or further reflected by a lower surface of the windshield 19 and transmitted through the light permeable facing ring 10. When a light G falls on the completed solar cell 1 in this manner, a power is generated. The power generated by the completed solar cell 1 is charged into a non-illustrated secondary battery through a non-illustrated boosting circuit and charging circuit mounted/formed on a circuit board 11 in the timepiece movement 5. The timepiece is driven upon receiving the power from the secondary battery.

A relationship between a panel cover diameter size and a power generation quantity will now be described.

Since the panel cover diameter of the timepiece according to this embodiment shown in FIG. 8 is smaller than the panel cover diameter of the timepiece shown in FIG. 6, the solar cell 2 partially overlaps and hence an area where no power is generated is produced. However, since the solar cell 2 is a single cell, a power generation quantity corresponding to a light receiving area can be obtained as different from the example in which a plurality of solar cells are connected in series in a circumferential direction as described in conjunction with the prior art.

Figure 9:
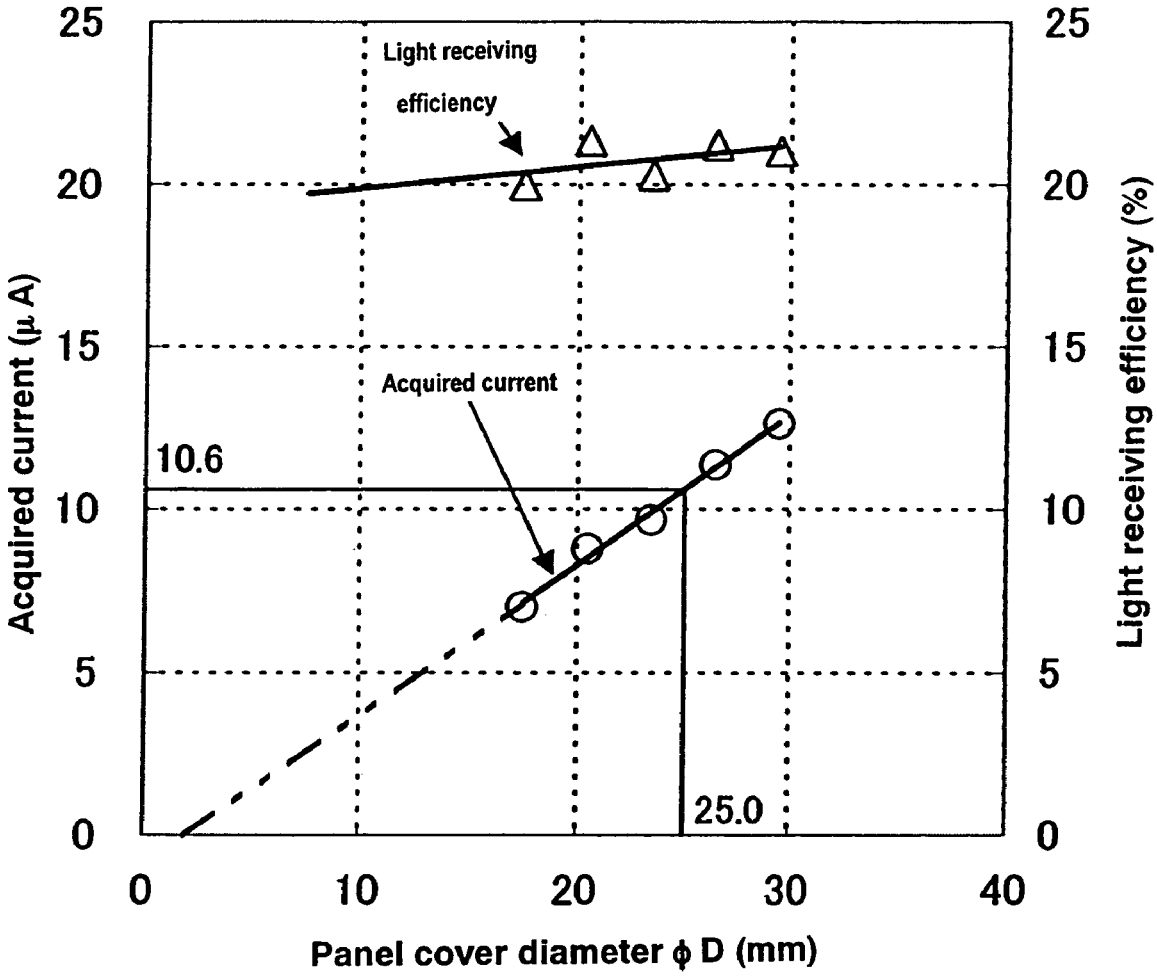
FIG. 9 is a graph obtained by measuring an acquired current and the light receiving efficiency with respect to a panel cover diameter of the electronic timepiece with a solar cell according to the embodiment of the present invention.

FIG. 9 is a graph obtained by measuring the power generation performance of the completed solar cell 1 when incorporated in timepiece cases having the configuration shown in FIG. 6 and different panel cover diameters and measuring an acquired current and the light receiving efficiency with respect to each panel cover diameter under the condition of the illuminance of 500 lux.

It is to be noted that the acquired current is a generated current in a state where a light having a fixed illumination intensity is applied from the vertical direction to the dial in a completed timepiece having the completed solar cell 1 incorporated therein, and the measurement was carried out under the conditions that an operating voltage of the completed solar cell 1 is 0.45 V and the dial has a black color.

Furthermore, the light receiving efficiency is a ratio of the acquired current with respect to a product of a power generation quantity (=a cell generation current) and an exposure ratio of a photovoltaic area obtained by winding when a light is applied from the perpendicular direction to the photovoltaic area in a state where the completed solar cell 1 is horizontally positioned with the same illumination intensity, and the light receiving efficiency can be represented by the following expression.

$$\text{Light receiving efficiency} = \text{Acquired current} \div \{\text{Cell generation current} \times \text{Exposure ratio}\} = \text{Acquired current} \div \text{Exposed cell converted generation current} \quad \text{(i)}$$

According to FIG. 9, it can be understood that the acquired current of the completed solar cell as a single cell used in this embodiment can be obtained in substantially proportion to a panel cover diameter. This means that the completed solar cell according to this embodiment is a single cell and power generation is carried out with a quantity corresponding to an area to which a light is applied even if a part of the photovoltaic area of the completed solar cell is hidden. This point is a large difference from the case where a plurality of solar cells are connected in series and arranged in the circumferential direction like the conventional example described in Patent Reference 1.

Moreover, it can be understood from FIG. 9 that the light receiving efficiency reaches a level of approximately 22% with a panel cover diameter of ϕ29.5 mm and a level of approximately 20% with a panel cover diameter of ϕ13 mm in terms of an approximate line.

A relationship between a power consumption of a timepiece used in this embodiment and a power generation quantity obtained by the completed solar cell will now be described.

(1) Timepiece Power Consumption

A timepiece used in the description of this embodiment has a specification as an analog timepiece with three hands and a date, and its timepiece power consumption is 0.53 μA.

Therefore, a power consumption required to drive hands for one day=12.7 μa·hr . . . (ii) is achieved.

(2) Power Generation Performance of Completed Solar Cell When Incorporated in Timepiece Case of Size Described in this Embodiment A generated current of the completed solar cell=60 μA (Conditions: the illuminance of 500 lux, the operating voltage of 0.45 V, the completed solar cell horizontally placed)

The electronic timepiece with a solar cell according to this embodiment uses a single solar cell, an open-circuit voltage Voc of the completed solar cell is 0.6 V, and a power generation voltage must be boosted in order to charge an Li secondary battery having a rated voltage of 1.35 V.

Assuming that a boosting system has the specification in which a boosting ratio is threefold and the boosting efficiency is 90%, a power generation quantity in a completed timepiece under the average light irradiation conditions per day can be calculated based on the following expression.

$$\text{Power generation quantity} = \text{Irradiation time} \times \text{Exposed cell body converted generation current} \times \text{Light receiving efficiency} \times \text{Boosting efficiency} - \text{Boosting ratio} \quad \text{(iii)}$$

When Expression (i) is substituted for (iii), the following expression can be obtained.

$$\text{Power generation quantity} = \text{Irradiation time} \times \text{Acquired current} \times \text{Boosting efficiency} \div \text{Boosting efficiency} \quad \text{(iv)}$$

Here, if the power generation quantity in the completed timepiece under the average irradiation conditions per day of Expression (iv) is larger than the power consumption required to drive the hands per day in Expression (ii), the power generation quantity can be achieved as a timepiece.

That is, attaining the following expression can suffice.

$$\text{Timepiece power consumption} \times 24\ \text{hr} \leqq \text{Irradiation time} \times \text{Acquired current} \times \text{Boosting efficiency} \div \text{Boosting efficiency} \quad \text{(v)}$$

Therefore, assuming that the illuminance is 500 lux and the irradiation time is 4 hr as the average irradiation conditions per day, the minimum acquired current can be represented by the following expression based on Expression (v).

$$\text{Minimum acquired current} = \text{Timepiece power consumption} \times 24\,hr \times \text{Boosting efficiency} \div \text{Irradiation time} \div \text{Boosting efficiency} = 0.53\,\mu A \times 24\,hr \times 3 \div 4\,hr \div 90\% = 10.6\,\mu A$$

It can be read from the graph of the acquired current with respect to the panel cover diameter of FIG. 9 that the panel cover diameter with respect to the acquired current 10.6 μA is approximately 25 mm. That is, it can be confirmed that setting the panel cover diameter to 25 mm or above in order to obtain a power generation quantity which is sufficient to function as a timepiece.

It is to be noted that the description has been given as to the possibility that the timepiece can be configured with the panel cover diameter of up to 24 mm in case of the women's timepiece shown in FIG. 8, but setting the panel cover diameter to 25 mm or above in the timepiece movement used in the explanation of this embodiment can suffice considering the power generation performance with respect to the timepiece power consumption.

As described above, according to the present invention, the electronic timepiece with the solar cell in which a panel cover diameter is 25 mm or above can be driven by using the slender strip-shaped solar cell 2 having a length of approximately 96.8 mm, a width of 2.4 mm and a thickness of approximately 0.15 mm. Of course, when a reduction in power consumption of the timepiece movement advances, when the light receiving efficiency in the facing ring 10 is improved, or when the performance of the power generation capability of the solar cell is improved, an electronic timepiece with a solar cell in which a panel cover diameter is 24 mm or below can be driven.

The light receiving efficiency is also dependent on a color of the dial. That is, the light receiving efficiency is increased when a dial has a white color or a bright color with which the reflection of a light on the dial is apt to occur, whilst the light receiving efficiency is reduced when the dial color is black and, comparing the black color and the white color, the light receiving efficiency becomes twofold or above when the white color is used, and hence a timepiece with a smaller panel cover diameter can be configured by using the dial having a bright color.

Moreover, in the explanation of this embodiment according to the present invention, the description has been given by using the strip-like solar cell as a single cell, but it is possible to use a solar cell such as a two-stage cell obtained by dividing the solar cell 2 in the longitudinal direction into upper and lower cells.

Figure 10:
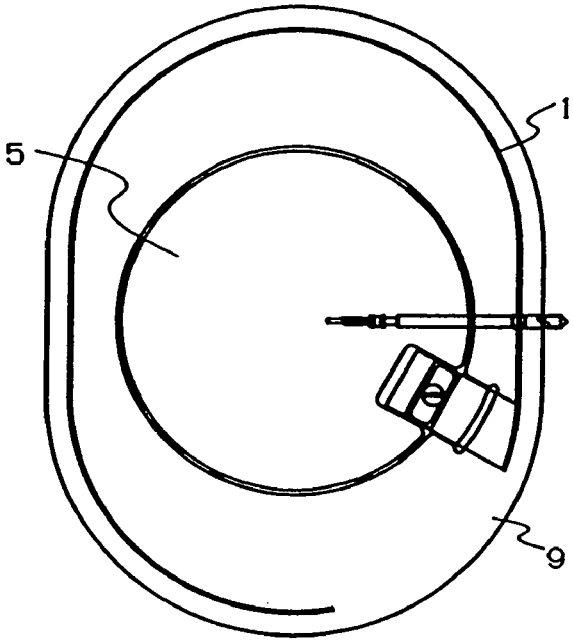
FIG. 10 is a plan view of another embodiment of the electronic timepiece with a solar cell according to the present invention, showing a state in which a timepiece movement is incorporated in a casing ring.
Figure 11:
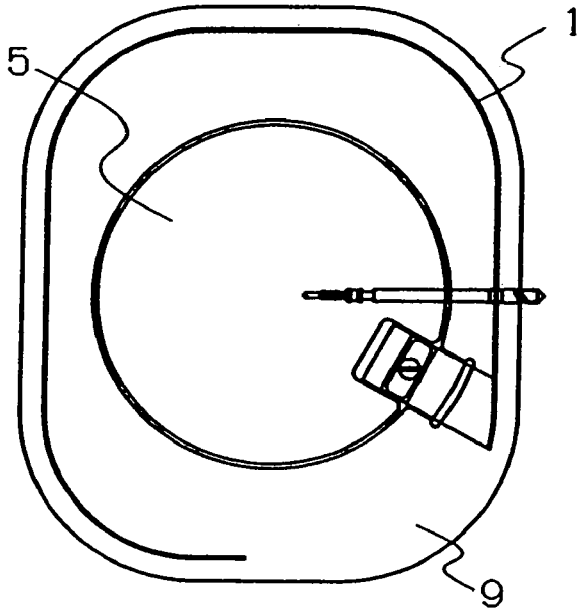
FIG. 11 is a plan view of still another embodiment of the electronic timepiece with a solar cell according to the present invention, showing a state in which a timepiece movement is incorporated in a casing ring.

FIGS. 10 and 11 show other embodiments according to the present invention, and illustrate examples in which the timepiece movement according to the present invention is used in timepieces having elliptic and rectangular dial with round corners. These embodiments are the same as the foregoing embodiment except that the casing ring 9 has an elliptic shape or the like, the completed solar cell 1 is arranged at a non-illustrated step portion of the casing ring 9, the timepiece movement 5 is fitted in the casing ring 9, and the completed solar cell 1 is connected with the timepiece movement 5. With this configuration, the present invention can be applied to a solar-powered timepiece using a panel cover shape other than a circular shape.

However, when a circumferential length of the panel cover shape is longer than the solar cell depending on a shape and a size of the panel cover, the solar cell has an opened shape. However, in this case, a cut line can be hard to see from the outside of the timepiece by coordinating a color tone of the casing ring with a color tone of the solar cell.

FIGS. 12 to 16 show still other embodiments according to the present invention, which are examples in which the timepiece movement according to the present invention is used in timepieces having designs in which the dial has a rectangular or barrel shape with a small radial angle.

It is known that the dial of a wrist watch takes various shapes such as a rectangular shape, a barrel shape or the like as well as a circular shape in accordance with a design of an external case. On the other hand, when amorphous silicon adopted as a photovoltaic member of the solar cell is bent with a small radium, e.g., 500 μm or below, amorphous silicon is cracked or destructed. Therefore, when the solar cell is bent in accordance with corner portions of a rectangular shape, a barrel shape or the like, amorphous silicon does not function as the photovoltaic member. Therefore, a configuration in which a solar cell is arranged vertically with respect to a dial cannot be adopted in an electronic time piece having a dial which has a rectangular shape, a barrel shape or the like with small-radius angular portions.

The electronic timepiece with a solar cell according to this embodiment can solve the above-described problems and cope with various timepiece designs.

Figure 12:
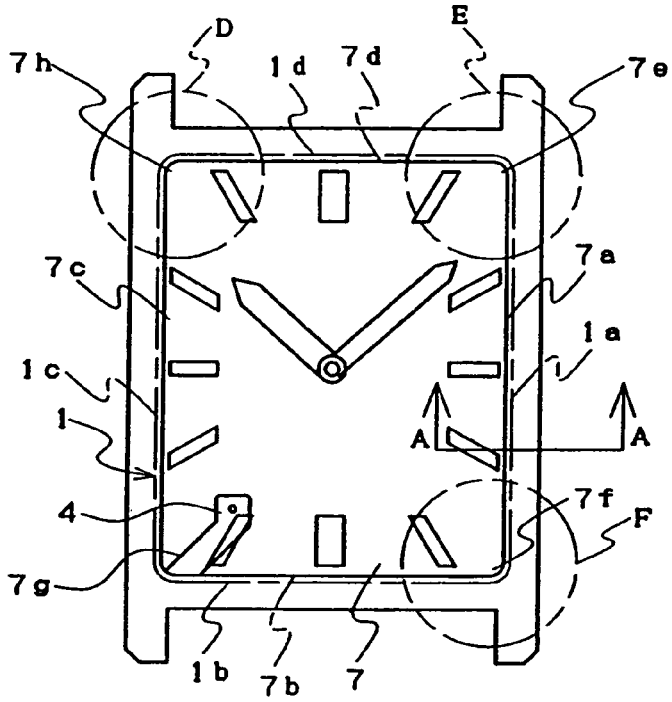
FIG. 12 is a plan view of an electronic timepiece with a solar cell showing yet another embodiment according to the present invention.

The dial 7 of the electronic timepiece with a solar cell shown in FIG. 12 has an outer peripheral shape which is a rectangular shape as one of orthogonal shapes. The external shape of this dial 7 has a plurality of sides 7*a*, 7*b*, 7*c* and 7*d* forming a main outer periphery and angular portions (intersections) 7*e*, 7*f*, 7*g* and 7*h* which connect the side 7*d* with the side 7*a*, the side 7*a* with the side 7*b*, the side 7*b* with the side 7*c* and the side 7*c* with the side 7*d*.

The completed solar cell 1 comprises a plurality of photovoltaic portions (photovoltaic areas) 1*a*, 1*b*, 1*c* and 1*d* arranged at parts except the angular portions 7*e*, 7*f*, 7*g* and 7*h* of the dial 7. The plurality of photovoltaic portions 1*a*, 1*b*, 1*c* and 1*d* are arranged in series and formed into a strip shape in which these members are electrically connected with each other in parallel. This completed solar cell 1 is arranged along the plurality of sides 7*a*, 7*b*, 7*c* and 7*d* of the dial 7 as indicated by a broken line.

Figure 13:
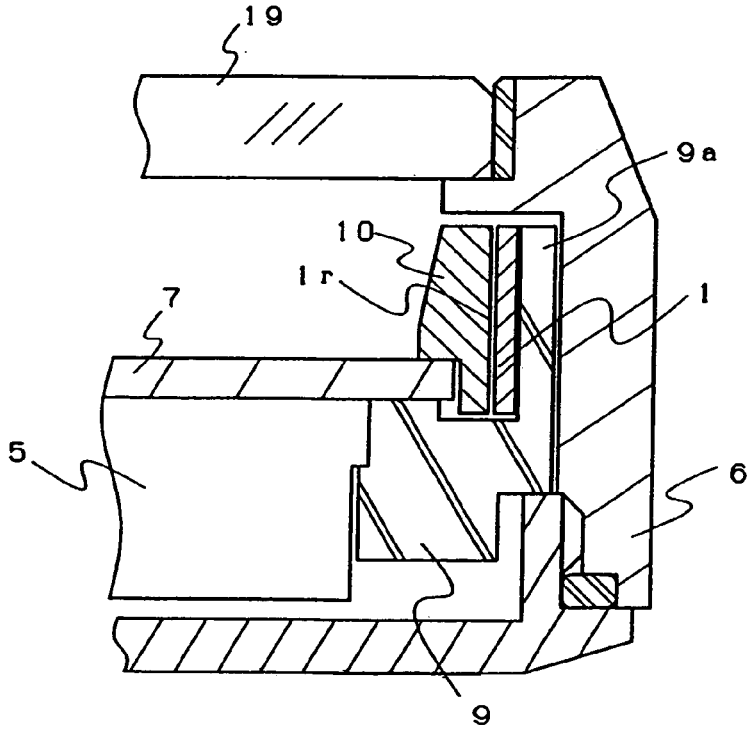
FIG. 13 is a cross-sectional view taken along a line A-A in FIG. 12.

FIG. 13 is a cross-sectional view taken along a line A-A in FIG. 12, in which the movement 5 of the electronic timepiece is arranged below the dial 7 like a conventional electronic timepiece. Reference numeral 6 denotes an external case, reference numeral 9 designates a casing ring which holds the movement 5 of the electronic timepiece, and the movement 5 is held by the external case 9 by interposing the casing ring 9 between the outside of the movement 5 and the external case 6.

The completed solar cell 1 is annularly arranged substantially vertically with respect to the dial 7 along the plurality of sides 7*a*, 7*b*, 7*c* and 7*d* of the dial 7 as indicted by a broken line in FIG. 12 in a state where the completed solar cell 1 is set against a banking portion 9*a* of the casing ring 9 in such a manner that a light receiving surface 1*r* is set on the dial inner peripheral side. A facing ring 10 is arranged on the light receiving surface 1*r* side of the completed solar cell 1 to hold the strip-like solar cell 1 and improve the appearance of the electronic timepiece. The facing ring 10 is formed of a light-permeable material which can receive a light, and annularly arranged with respect to the dial 7 like the completed solar cell 1.

As described above, when the completed solar cell 1 is arranged substantially vertically with respect to the dial 7 along the plurality of sides 7*a*, 7*b*, 7*c* and 7*d* of the dial 7, parts of the strip-like completed solar cell 1 corresponding to the rectangular angular portions 7*e*, 7*f* and 7*h* of the dial 7 are bent at D, E and F portions shown in FIG. 12 and the completed solar cell 1 is thereby held between the banking portion 9*a* of the casing ring 9 and the facing ring 10.

A configuration of the strip-like completed solar cell 1 will now be described with reference to FIGS. 14 to 16. It is to be noted that the parts of the completed solar cell 1 corresponding to the D, E and F sections shown in FIG. 12 are shown as d, e and f sections in a development elevation of FIG. 14.

The completed solar cell 1 has an amorphous silicon layer constituting a photovoltaic portion mounted on a substrate 2. The amorphous silicon layer 21 is a photovoltaic portion which converts the light energy into the electrical energy. In this embodiment, a plastic film substrate is used as the substrate 2. A metal foil 22 of, e.g., aluminum is formed on this film substrate 2. This metal foil 22 serves as an electrode on an anode side which fetches the power generated by the amorphous silicon layer 21.

Figure 14:
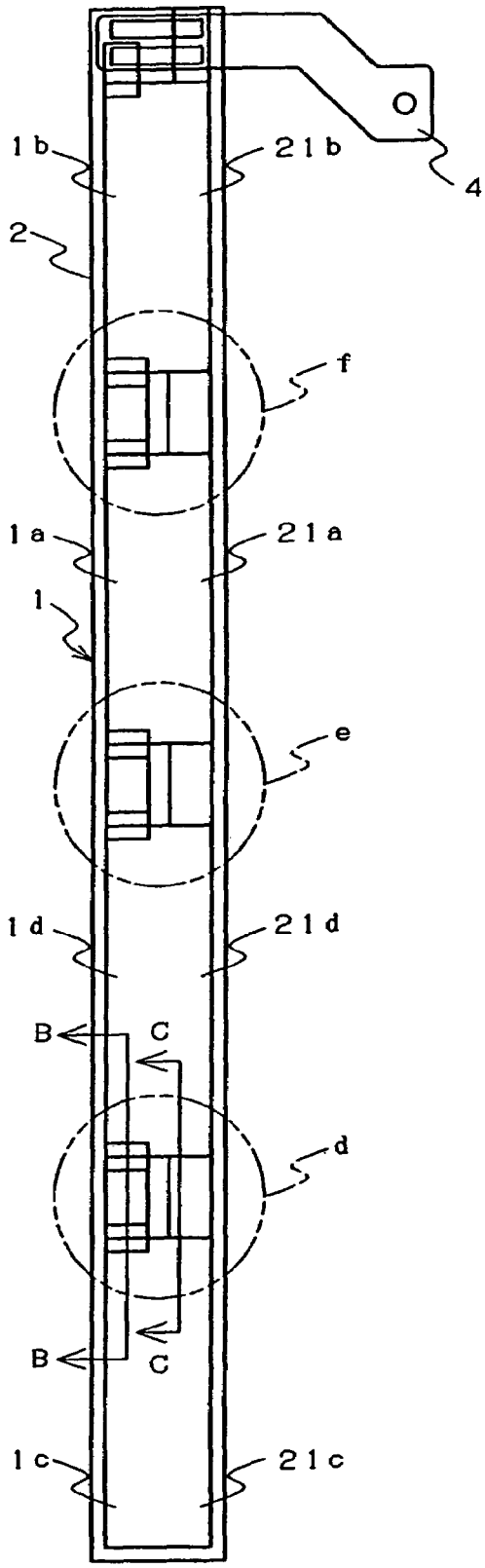
FIG. 14 is a solar cell plan view obtained by developing the completed solar cell depicted in FIG. 12 in plan.

The d, e and f sections of the strip-like completed solar cell 1 shown in FIG. 14 all have the same cross-sectional configuration.

Figure 15:
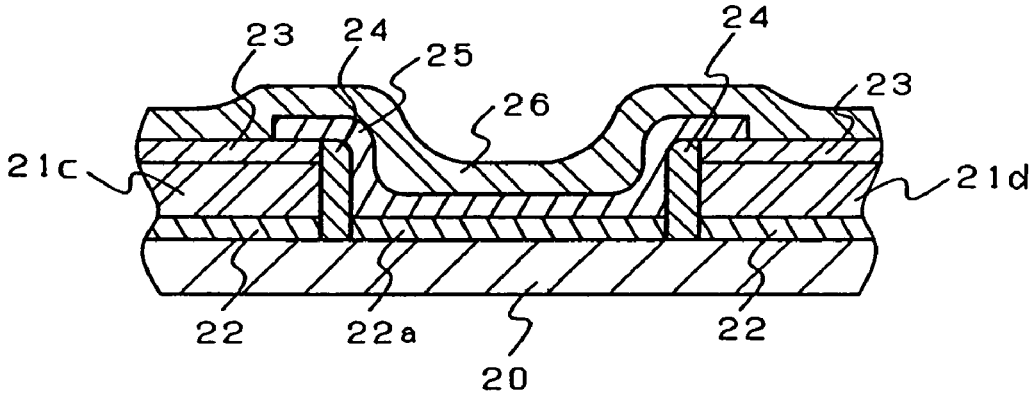
FIG. 15 is a cross-sectional view of the completed solar cell taken along a line B-B in FIG. 14.
Figure 16:
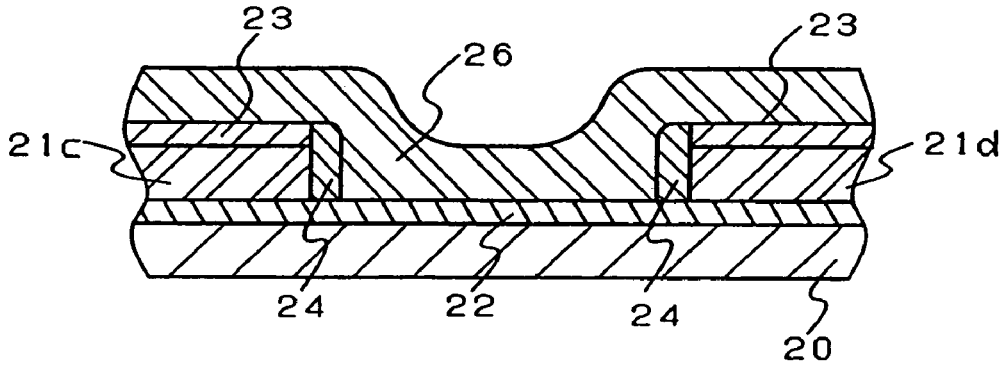
FIG. 16 is a cross-sectional view of the completed solar cell taken along a line C-C in FIG. 14.

Here, FIG. 15 shows a B-B cross-sectional view of a cross-sectional configuration of the d section, and FIG. 16 shows a C-C cross-sectional view of the same. In FIG. 16, the metal foil 22 serves as a common electrode which connects a pole of the amorphous silicon layer 21*d* on the right side with the same pole of the amorphous silicon layer 21*c* on the left side, while it does not connect the amorphous silicon layers 21*c* and 21*d* on the both sides with each other but has an independent pattern to function as a later-described connection electrode 22*a* in FIG. 15.

A transparent conductive film 23 is formed on an upper surface of the amorphous silicon layer 21 and an incident light side of the amorphous silicon layer 21, and serves as an electrode on a cathode side for the generated power.

An insulating member 24 prevents the upper and lower electrodes of the amorphous silicon layer 21 which is divided into right and left parts, the transparent conductive film 23 and the metal foil 22 from being short-circuited.

A conductive member 25 electrically connects the transparent conductive film 23 formed on the upper surface of the right amorphous silicon 21*d*, the transparent conductive film 23 formed on the upper surface of the left amorphous silicon layer 21*c* and the connection electrode 22*a* with each other. As a result, the right amorphous silicon layer 21*d* is electrically connected with the left amorphous silicon layer 21*c*.

A protection film 26 is a transparent insulating material which covers the surface of the solar cell 1.

As described above, the transparent conductive films 23 serve as electrodes on a cathode side arranged on the upper surface side of the right and left amorphous silicon layers 21*d* and 21*c*, and are electrically connected with each other by the connection electrode 22*a* and the conductive member 25 (FIG. 15). Further, the electrodes on the anode side arranged on the lower surfaces of the both right and left amorphous silicon layers 21*d* and 21*c* are electrically connected with each other by the metal film 22 (FIG. 16). Likewise, as to each amorphous silicon layer shown in FIG. 14, the amorphous silicon layer 21*a* is connected with the amorphous silicon layer 21*d*, the amorphous silicon layer 21*d* is connected with the amorphous silicon layer 21*c*, and the respective amorphous silicon layers 21*a*, 21*b*, 21*c* and 21*d* are connected in parallel.

A connection terminal 4 which connects the power generated by the four amorphous silicon layers 21*a*, 21*b*, 21*c* and 21*d* to the movement 5 of the electronic timepiece is pressure-welded to the right end portion of the completed solar cell 1.

When accommodating the above-described completed solar cell 1 in the external case 6 of the electronic timepiece with a solar cell, the d section shown in FIG. 14 is assembled in the D section shown in FIG. 12, the e section is likewise assembled in the E section and the f section is assembled in the F section, thereby achieving accommodation.

Since the amorphous silicon layer 21 is very fragile, there is no problem when a curvature radius is large, but the amorphous silicon layer 21 cannot withstand and is cracked when a curvature radius is small. Generation of cracks provokes the short circuit between the metal electrode 22 and the transparent conductive film 23 constituting the upper and lower electrodes or the short circuit due to permeation of moisture, thereby deteriorating the power generation function.

However, according to the completed solar cell of this embodiment, the configuration which can withstand bending with a small radius is adopted, no crack is generated at parts corresponding to the respective angular portions 7*e*, 7*f*, 7*g* and 7*h* of the dial 7, and the electrical connection of each amorphous silicon layer 21 can be assured.

Figure 17:
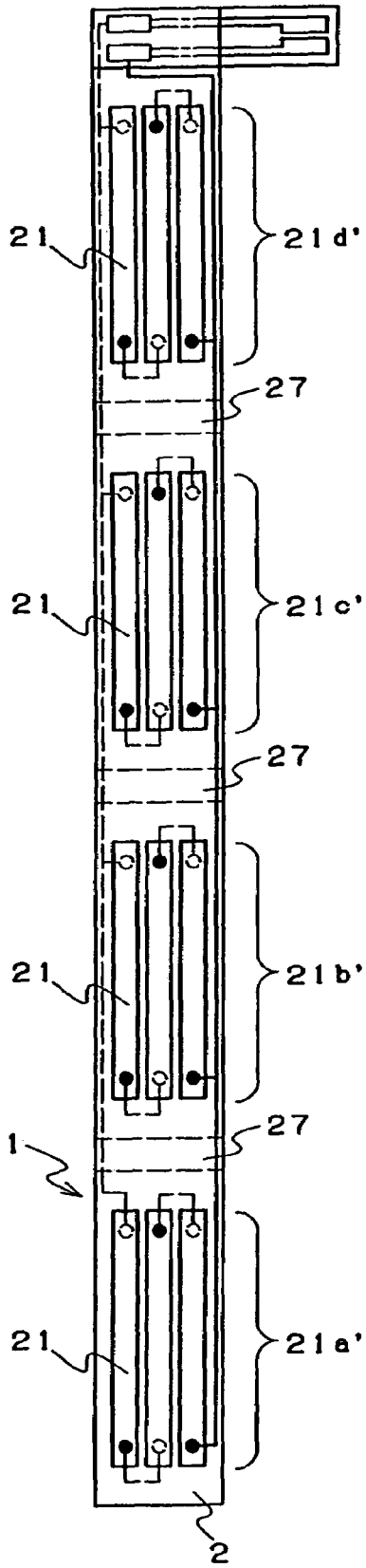
FIG. 17 is a plan view of a completed solar cell according to a further embodiment showing a state in which a plurality of amorphous silicon layers are electrically connected with each other.
Figure 18:
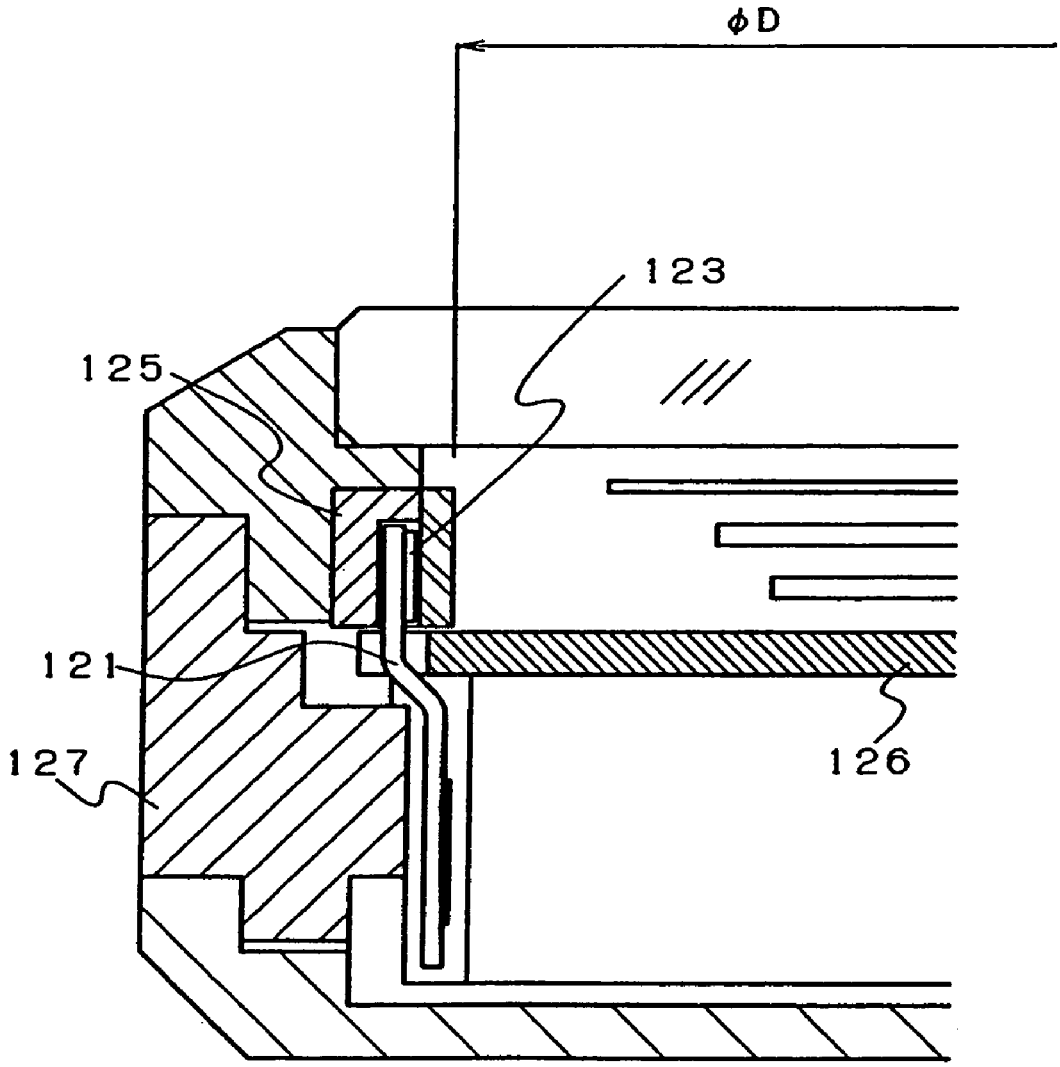
FIG. 18 is a cross-sectional view of a primary part of a timepiece with a solar cell showing a first embodiment described in Patent Reference 1.
Figure 19:
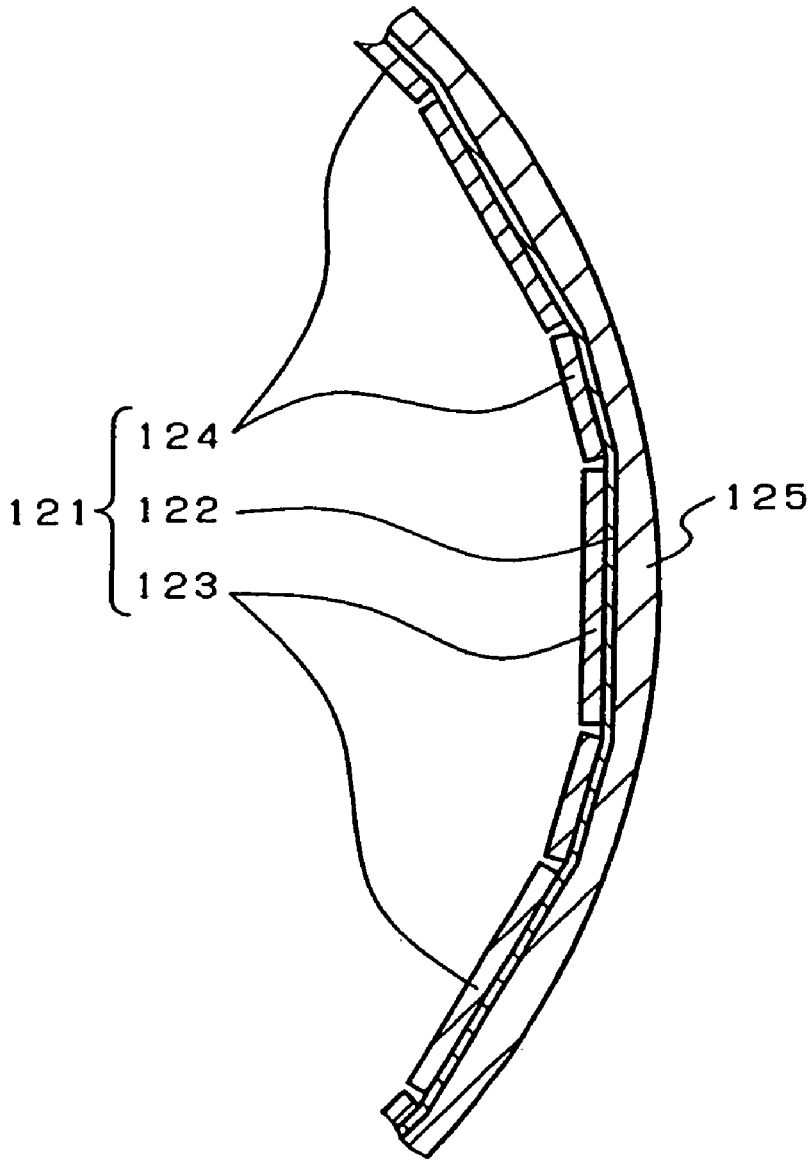
FIG. 19 is a cross-sectional view of a primary part of a solar cell block showing the first embodiment described in Patent Reference 1.
Figure 20:
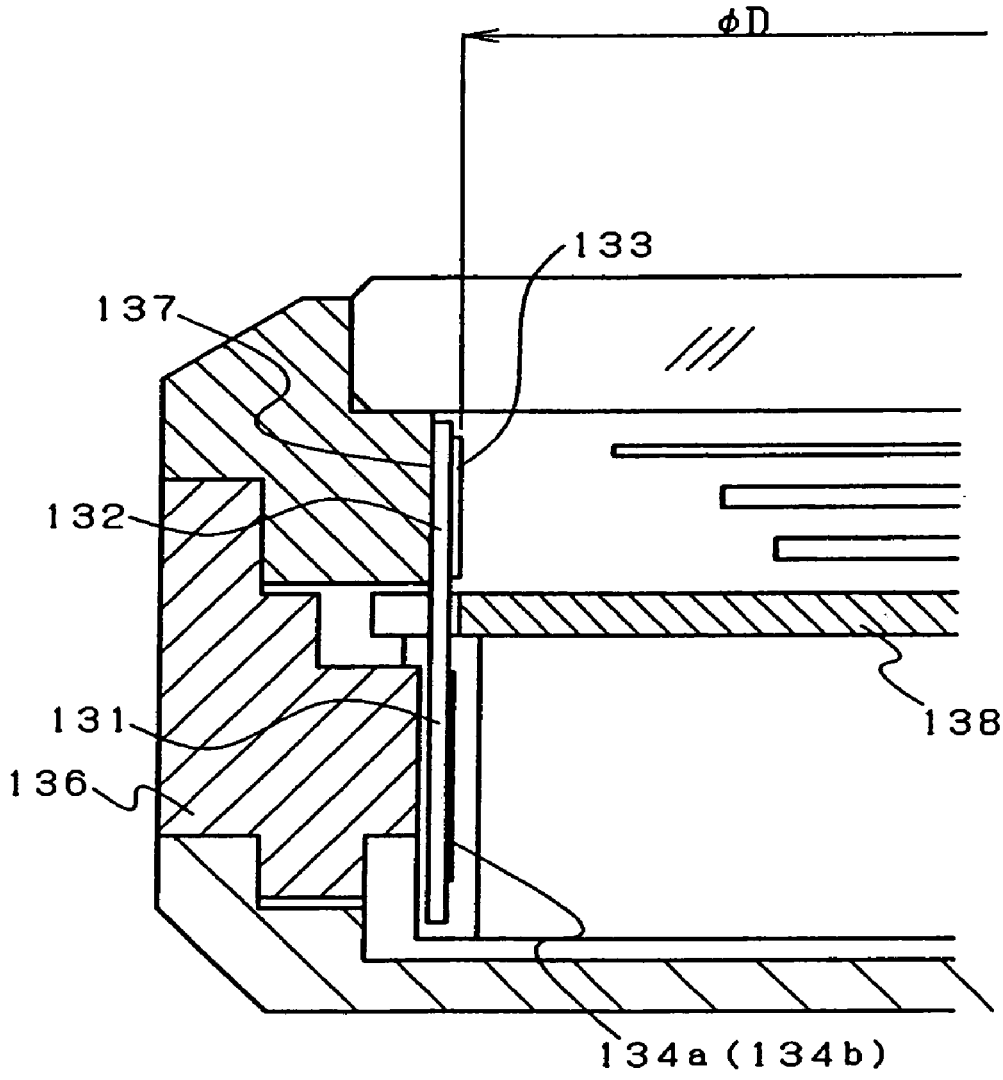
FIG. 20 is a cross-sectional view of a primary part of a timepiece with a solar cell showing a second embodiment described in Patent Reference 1.
Figure 21:
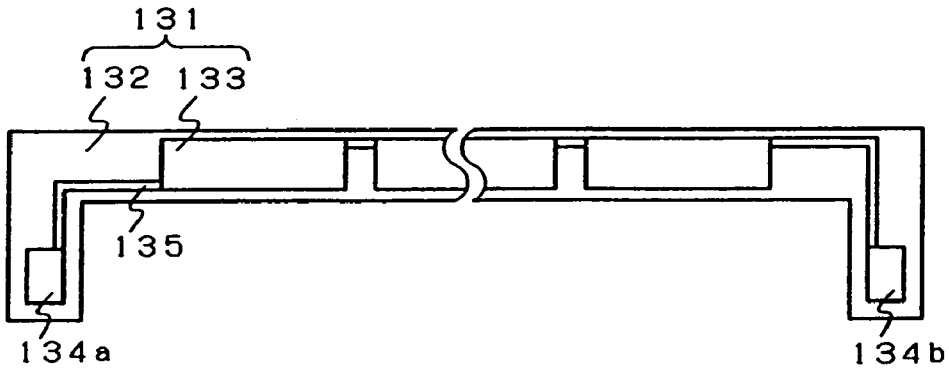
FIG. 21 is a plan view of a solar cell block showing the second embodiment described in Patent Reference 1.
Figure 22:
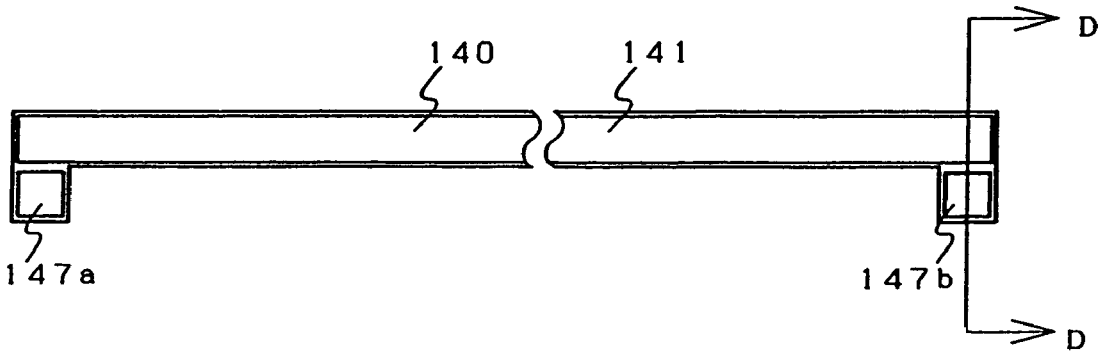
FIG. 22 is a plan view of a solar cell body according to a first embodiment described in Patent Reference 2.
Figure 23:
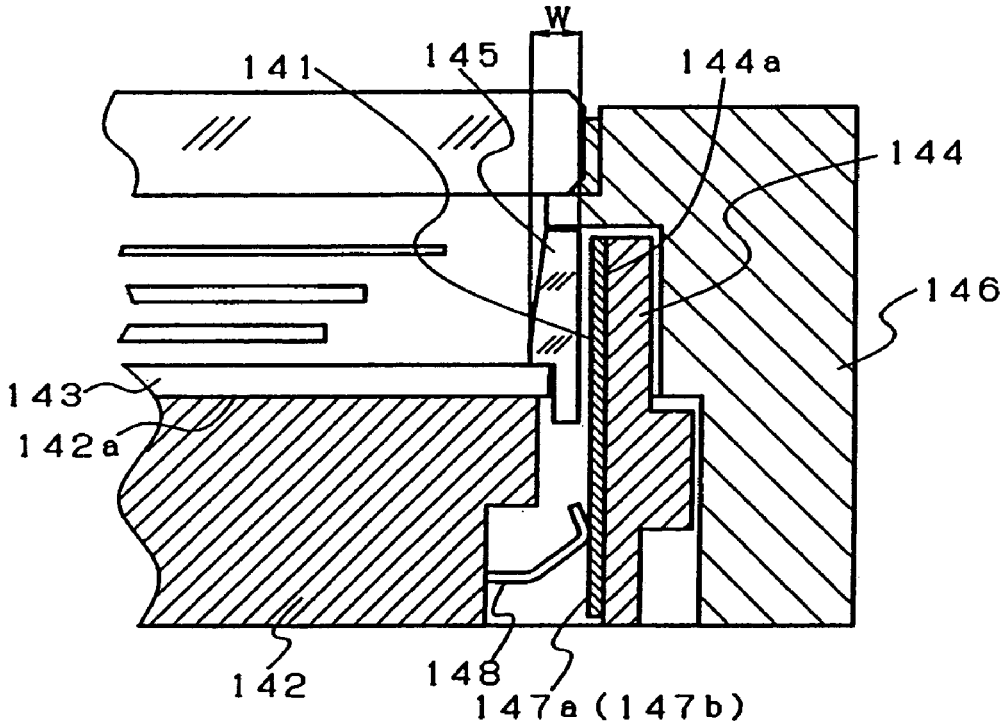
FIG. 23 is a cross-sectional view of an electronic timepiece with a solar cell according to the first embodiment described in Patent Reference 2.

It is to be noted that the electronic timepiece with a solar cell in which the four amorphous silicon layers are electrically connected in parallel in one completed solar cell is configured in the embodiment shown in FIG. 14, but an embodiment having such a configuration as shown in FIG. 17 can be also employed. That is, a plurality of strip-like amorphous silicon layers 21 are arranged in a widthwise direction of the substrate 2 to configure a solar cell unit in which the plurality of amorphous silicon layers 21 are electrically connected in series. Further, the solar cell units whose number corresponds to a plurality of sides of the dial 7 (four solar cell units 21*a*', 21*b*', 21*c*' and 21*d*' corresponding to four sides 7*a*, 7*b*, 7*c* and 7*d* in FIG. 17) are provided, and these solar cell units are arranged substantially vertically to the dial along the respective sides of the dial 7. On the other hand, flexible conductive members 27 are arranged at parts corresponding to the angular portions 7*a*, 7*b*, 7*c* and 7*d* of the dial 7. Furthermore, the plurality of solar cell units are electrically connected in parallel to provide a completed solar cell.

INDUSTRIAL APPLICABILITY

According to the present invention, the electronic timepiece with a solar cell using the metal dial can be provided by arranging the solar cell at the facing portion, and it is possible to provide the electronic timepiece with a solar cell which can use the common timepiece movement and the common completed solar cell irrespective of a panel cover diameter size.

The invention claimed is:

1. An electronic timepiece with a solar cell comprising: a timepiece movement, a timepiece case which accommodates the timepiece movement therein, a casing ring which accommodates and holds the timepiece movement in the timepiece case, a solar cell, a circuit board to which generated power of the solar cell is supplied, and a dial; the solar cell being arranged substantially vertically with respect to the dial, wherein the solar cell has a photovoltaic area arranged substantially vertically relative to the dial and facing a center of the timepiece movement, and is arranged at a solar cell positioning portion provided in the casing ring, and wherein the solar cell has an extraction electrode for extracting the generated power from the solar cell, said extraction electrode being arranged to extend from the solar cell substantially perpendicularly to an elongated direction of the solar cell, and connected to the circuit board at an area where the extraction electrode is extended.

2. The electronic timepiece with a solar cell according to claim 1, wherein the solar cell is a slender strip-shaped solar cell formed on a flexible substrate.

3. The electronic timepiece with a solar cell according to claim 1, wherein positive and negative electrodes of the solar cell are arranged at the same side end portion of the solar cell.

4. The electronic timepiece with a solar cell according to claim 1, wherein the extraction electrode which fetches the generated power of the solar cell and the solar cell are separately manufactured and bonded.

5. The electronic timepiece with a solar cell according to claim 1, wherein the casing ring has a hole portion to which the extraction electrode is inserted.

6. The electronic timepiece with a solar cell according to claim 1, wherein the extraction electrode has a slot so that the extraction electrode can be adjustably attached to the circuit board.

7. The electronic timepiece with a solar cell according to claim 1, wherein the casing ring has an annular shape disposed outside the dial, and the solar cell positioning portion is formed at an inner surface of the casing ring.

8. The electronic timepiece with a solar cell according to claim 1, wherein the circuit board is arranged beneath the timepiece movement, and the solar cell is arranged perpendicular to the circuit board.

9. The electronic timepiece with a solar cell according to claim 1, wherein the circuit board is arranged under the timepiece movement and the solar cell is arranged substantially vertically relative to the circuit board, and the extraction electrode is bent.

10. The electronic timepiece with a solar cell according to claim 1, wherein the solar cell surrounds the dial outside thereof.

11. An electronic timepiece with a solar cell comprising: a timepiece movement, a timepiece case which accommodates the timepiece movement therein, a casing ring which accommodates and holds the timepiece movement in the timepiece case, a solar cell, and a dial; the solar cell being arranged substantially vertically with respect to the dial, wherein the solar cell has a photovoltaic area arranged substantially vertically relative to the dial and facing a center of the timepiece movement, and is arranged at a solar cell positioning portion provided in the casing ring, and wherein the dial is a dial having a plurality of sides forming a main outer peripheral shape and angular portions which connect intersections of the plurality of sides, the solar cell has a plurality of photovoltaic portions which are arranged along the plurality of sides of the dial and substantially vertically with respect to the dial, and the plurality of photovoltaic portions are electrically connected with each other in parallel.

12. The electronic timepiece with a solar cell according to claim 11, wherein the photovoltaic portion has a configuration in which a plurality of amorphous silicon layers are arranged in a widthwise direction of the substrate and electrically connected in series.

13. The electronic timepiece with a solar cell according to claim 11, wherein an outer peripheral shape of the dial formed by using the plurality of sides and the angular portions is a rectangular shape.

14. The electronic timepiece with a solar cell according to claim 11, wherein an outer peripheral shape of the dial formed by using the plurality of sides and the angular portions is a barrel shape.

15. The electronic timepiece with a solar cell according to claim 11, wherein the circuit board is arranged under the timepiece movement and the solar cell is arranged substantially vertically relative to the circuit board, and the extraction electrode is bent.

16. An electronic timepiece with a solar cell comprising: a timepiece movement, a timepiece case which accommodates the timepiece movement therein, a solar cell, a circuit board to which generated power of the solar cell is supplied, and a dial, wherein the solar cell has a photovoltaic area arranged substantially vertically relative to the dial and facing a center of the timepiece movement, and wherein the solar cell has an extraction electrode for extracting the generated power from the solar cell, said extraction electrode being arranged to extend from the solar cell substantially perpendicularly to an elongated direction of the solar cell, and connected to the circuit board at an area where the extraction electrode is extended.

17. The electronic timepiece with a solar cell according to claim 16, wherein the circuit board is arranged under the timepiece movement and the solar cell is arranged substantially vertically relative to the circuit board, and the extraction electrode is bent.

* * * * *